United States Patent [19]

Whittaker Wolden B.

[11] 4,455,916

[45] Jun. 26, 1984

[54] ARMAMENT SHORTING ARRANGEMENT

[75] Inventor: Whittaker Wolden B., Geneva, Fla.

[73] Assignee: The United States of America as represented by the Secretary of the Navy, Washington, D.C.

[21] Appl. No.: 350,920

[22] Filed: Feb. 22, 1982

[51] Int. Cl.[3] ..... F42C 15/06

[52] U.S. Cl. ..... 89/1.812; 89/1.814; 89/1.816

[58] Field of Search ..... 89/1.812, 1.813, 1.814, 89/1.816, 1.819, 1.8

[56] References Cited

U.S. PATENT DOCUMENTS

| | | | |
|---|---|---|---|
| 2,640,417 | 6/1953 | Bjork et al. | 89/1.812 X |
| 3,049,976 | 8/1962 | Hereth et al. | 89/1.812 X |
| 4,128,039 | 12/1978 | Skliris | 89/1.814 X |
| 4,271,748 | 6/1981 | Ward | 89/1.812 X |

*Primary Examiner*—David H. Brown

*Attorney, Agent, or Firm*—R. F. Beers; K. E. Walden

[57] ABSTRACT

A rocket propelled missile round prepackaged in an environmentally sealed and electromagnetic interference protected container is adapted to be loaded into the rear of a portable hand-held launch tube for launching. The prepackaged round container is provided with pairs of electrical contacts on its exterior for receiving rocket motor ignition current from the launcher. The contact pairs are normally electrically shorted, but the shorting is adapted to be disestablished or "off shorted" by means within the launch tube, when the prepackaged round is received therein, for allowing selective ignition of the round's rocket motor.

15 Claims, 4 Drawing Figures

ARMAMENT SHORTING ARRANGEMENT

BACKGROUND OF THE INVENTION

Prior efforts have been directed toward the design of portable rocket launchers for use by troops in the field. Such efforts have resulted in equipment having substantial shortcomings. For example, they have been heavy and often required considerable manual manipulation by the operator in loading and firing a round. Furthermore, rounds having circuitry for electrical ignition lacked safety jacketing and features for protecting them during handling and storage and to prevent inadvertent ignition of the rocket motor by stray electromagnetic radiation. There has been provided by the present invention a rugged lightweight yet reliable launcher adapted to receive a specially designed and constructed prepackaged rocket round missile for launching with maximum safety and with minimum attention to details by the operating troops. The container which prepackages the missile is provided with electromagnetic interference (EMI) shielding and armament shorting to minimize inadvertent ignition of the rocket motor by stray electromagnetic fields. The prepackaged rocket or rounded container is, however, adapted for rough handling under field use conditions, and for loading into the rocket launcher in an uncomplicated straightforward manner with minimal regard to physical orientation or registry and with practically no further manual manipulation by the operator other than aiming and firing. Furthermore, the prepackaged round container can be removed from the launcher without launch, and, once again, it reverts to its initial relatively safe condition.

SUMMARY OF THE INVENTION

This invention relates to a prepackaged rocket round having an armament safety shorting feature, and it is adapted to be launched from a rocket launcher having a tube with features complimentary to and cooperating with the safety feature of the round. The rocket round is prepackaged in an environmental sealed and electromagnetically shielded container which is provided with armament shorting means to minimize inadvertent ignition of the rocket motor by stray electromagnetic radiation. The launch tube is adapted to receive the prepackaged round for launching, and, in the process, inactives its armament shorting feature and provides electrical power thereto for selectively energizing the rocket motor ignition circuitry for initiating launch.

It is, therefore, an object of the invention to provide an improved rocket launcher and prepackaged rocket propelled missile round with armament safety features.

It is another object of the invention to provide a rocket launcher and prepackaged rocket propelled missile round with cooperating features for minimizing opportunity of inadvertent ignition of the rocket motor.

It is still another object of the invention to provide a prepackaged rocket propelled missile round having armament shorting mechanism for minimizing opportunity of external stray electromagnetic radiation from initiating a flow of current in the round ignition system which might inadvertently ignite the motor.

It is yet another object of the invention to provide a rocket launcher tube adapted to receive the prepackaged rocket missile or round for launch, inactive the armament shorting mechanism on the prepackaged round, and provide electrical power to the missile round for selective ignition of its rocket motor.

It is a still further object of the invention to provide a prepackaged rocket propelled missile or round having an armament shorting mechanism which retains its electrical shorting function even when it is subjected to directional forces during rough handling, and reverts to its shorted condition upon being unloaded from the launch tube.

It is recognized that other advantages and other objects of the invention will become apparent in view of the more detailed description of the invention embodied in the specification and illustrated in the drawings which follow.

DETAILED DESCRIPTION AND OPERATION

Figure 1:
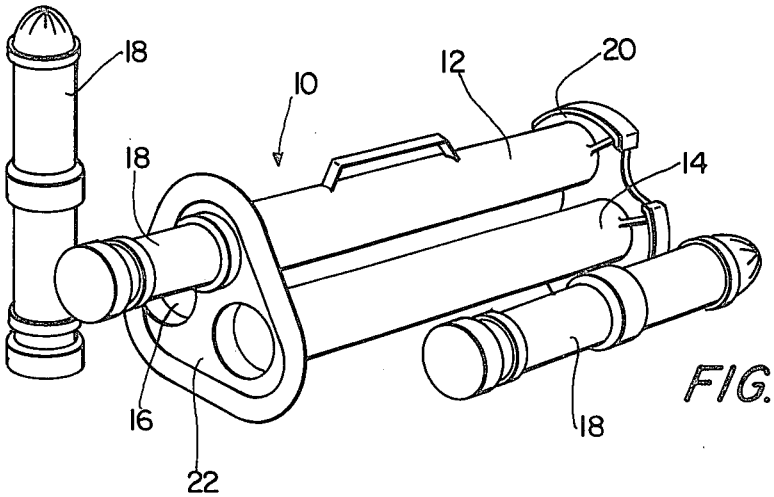
FIG. 1 is a perspective representation of a hand-held three tube cluster rocket launcher illustrating a prepackaged round missile loaded into the rear of one of the launch tubes in position for firing.

Referring now to the drawings there is illustrated in FIG. 1 a rocket launcher 10 formed of a cluster of three launch tubes 12, 14, and 16 which are adapted for launching prepackaged rounds 18 one of which is illustrated in firing position.

The invention relates to features on both the launch tube and the prepackaged rounds and their cooperative functions. The launch tubes are preferably formed of a lightweight material for example processed cardboard or filament wound fiberglass reinforced resin for lightweight reliability and easy of handling. When arranged in a cluster embodiment, the tubes may be secured together by forward and aft bulkheads 20 and 22, respectively, which extend around the perimeters of the tubes to protect them from physical shock in handling and use.

Figure 2:
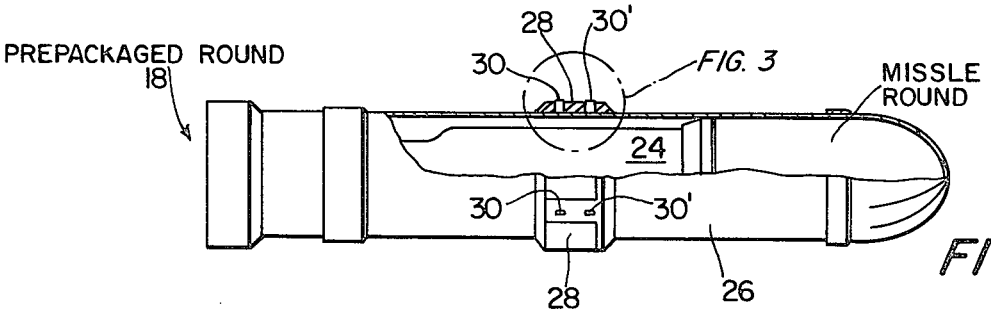
FIG. 2 is a side view of a prepackaged round having an interfacing ring intermediate its end.
Figure 3:
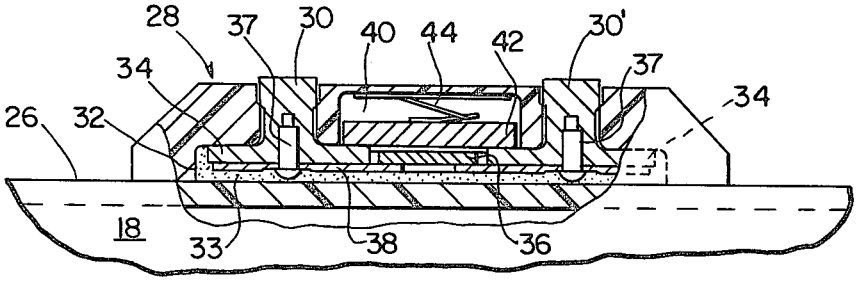
FIG. 3 is an enlarged cross-sectional view of the area circled in FIG. 2 illustrating electrical contacts and armament shorting details.

Prepackaged round 18 is illustrated by a partial cross-sectional view in FIG. 2. It comprises a rocket propelled missile or round 24 environmentally sealed within a cylindrical housing 26 which includes shielding for preventing entry of electromagnetic radiation. The housing, also formed of a lightweight material, is adapted to permit the round to exit therefrom upon firing of its rocket motor (illustrated in dashed outline 27). There is provided on the outer surface of housing 26, substantially midway between its ends, an annular electrical interface ring structure 28 which carries plural (at least three) pairs of axially spaced annularly arranged radially extending electrical contacts 30, 30'. An enlarged cutaway sectional view of interface ring 28 and housing 26 is shown in FIG. 3. Electrical contact pairs 30, 30' are securely mounted within ring 28, which itself is formed of a lightweight nonmagnetic material.

As illustrated in the FIG. 3 cross-sectional view, interface ring 28 is provided with an underlying recess 32 which may extend about the entire inner periphery of the ring for receiving bases 34 of axially space electrical contacts 30, 30'. Shank portions of the contacts extend radially outwardly through the wall of the ring a short distance for making electrical contact with corresponding electrical contacts provided on the internal surface of the launcher. A nonconductive support or spacer sleeve 36 is disposed between the contact bases. Each of the electrical contact pairs includes an attaching point (such as threaded screw 37) and circuit harness 38 adapted to receive wires of the rocket motor ignition circuitry from within housing 26. Recess 32 is filled with a material such as an epoxy resin 33 to cover the electrical contact basis and harness to define one method of assembly and means for securing interfacing ring 28 to housing 26.

Additional recesses 40 are provided in interface ring 28 between the pairs of electrical contacts 30,30'. Each recess houses an electrically conductive disc 42 formed of magnetic material. Each disc is resilient urged radially inwardly by spring 44 into normal electrical contact between bases 34 of electrical contact pairs 30, 30' for establishing electrical shorting therebetween. At least three of the shorting discs are arranged equally spaced about the interface ring between pairs of the electrical contacts. The conductive discs have mass. Therefore, if a lateral force is exerted on the prepackaged round (such as might occur during rough handling) which would tend to lift some of the discs away from their electrical shorting position, at least one of them will be urged with even more force against respective bases 34 to assure continuous electrical shorting. The separate pairs of contacts 30, 30' are wired in parallel with circuitry for the rocket motor (not illustrated). Therefore, shorting of only one pair of contacts is sufficient to minimize opportunity for externally generated electromagnetic radiation to enter the prepackaged round through these contacts.

Figure 4:
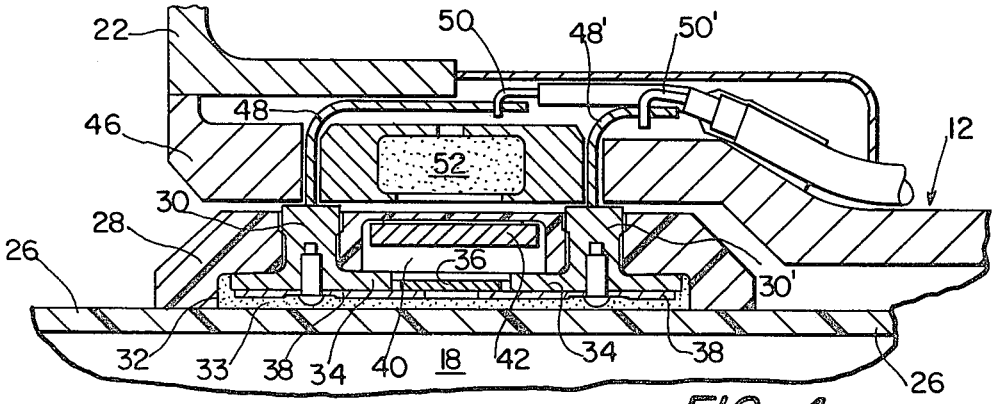
FIG. 4 is another enlarged cross-sectional view taken through a launch tube with the prepackaged round in position therein and ready for launch.

Referring now to FIG. 4, there is shown in cross-sectional view a portion of a prepackaged round 18 (as illustrated in FIG. 3) received into a launch tube (e.g., launch tube 12) in position for firing. The rear end of each launch tube is formed with a bell mouth portion 46 having a diameter sufficiently large to receive interface ring 28 of the prepackaged round. A pair of axially spaced apart resiliently mounted annular rings, defining electrical contacts 48 and 48', face inwardly around the inner periphery of the bell mouth. These contacts are supplied electrical power through wires 50 and 50' from a source (not illustrated) provided on the rocket launcher itself. The wall of the bell mouth end is provided with an inwardly facing recess for carrying magnet 52 (preferably a permanent magnet for simplicity) disposed about its inner periphery.

When prepackaged round 18 is loaded into the end of the launch tube as noted in FIG. 1 and illustrated in detail in FIG. 4, the missile is prepared for launch. When in this position, the prepackaged missile round is "off shorted," and the missile is otherwise armed for having its rocket motor ignited for launch. During loading of the missile, as soon as that portion of interface ring 28 which carries shorting discs 42 passes to a position under the influence of magnet 52, all shorting discs are lifted against their spring bias away from contact with bases 34 to disestablish shorting therebetween. At the same time, electrical contact is established between electrical contacts 30, 30' on the prepackaged round and contacts 48, 48' in the launch tube bellmouth. The missile round is now ready for launching, and can occur whenever the operator throws a trigger switch (not illustrated) to admit electrical power to the rocket round circuitry through electrical contacts 30, 30'. It will be appreciated as a safety feature that up until the very instant the prepackaged round is inserted into the launch tube, shorting discs 42 are urged against the bases of the contacts for shorting them, thus minimizing opportunity for electromagnetic radiation to enter the prepackaged round.

In the event a loaded round is not launched, and it is desired to remove the round from the launcher, all that is required is that it be withdrawn and the armament shorting for safety is reestablished. As interface ring 28 is withdrawn from bellmouth 46, shorting discs 42, once outside the influence of magnet 50, are caused to assume their normal shorting positions. At the same time, electrical power to contacts 30, 30' has been interrupted.

As noted in FIG. 4, launch tube 12 is carried in a cluster with other tubes, and the bulkhead includes a cover for part of the electrical circuitry, thereby providing protection during operation and from environmental conditions.

There has been disclosed in this specification a prepackaged missile round (having armament safety features) and a launch tube specifically adapted for receiving and launching the round. The prepackaged round is provided with mechanism to protect the round rocket motor from inadvertent firing due to the presence of stray electromagnetic radiation emanating from a source external of the round. The launch tube is designed, however, to override the round's armament safety feature once the round is loaded therein. The shorting discs are simply raised from shorting position once they come under the influence of the magnet. At the same time, electrical power is established for firing the round. But, should the round be unloaded from the launcher without firing, its armament safety feature is reestablished.

While this invention has been particularly shown and described with reference to specific embodiments thereof, it will be understood by those who are skilled in the art that various changes in form and detail may be made either to the round package or to the launcher without departing from the spirit and scope of the invention which is meant to be limited only by the scope of the annexed claims.

What is claimed is:

1. In combination:

a rocket motor propelled missile round and a launcher therefor;

said round having at least one pair of electrical contacts on its surface connecting with rocket motor ignition circuitry and adapted to receive electrical current from an outside source;

means normally shorting the round electrical contacts for preventing electrical current applied to the round contacts from entering the rocket motor ignition circuitry;

said launcher including a launch tube for receiving the round;

means on the launch tube for disestablishing the round shorting means when the round is loaded into the launch tube;

said launcher including an electrical power source and electrical contacts internally of the launch tube for engaging and selectively supplying current to the round contacts when the round is loaded into the launch tube;

whereby current selectively supplied to the round contacts passed therethrough to the rocket motor ignition circuitry for igniting the rocket motor.

2. The invention as claimed in claim 1 further defined by the shorting means comprising an electrically conductive shorting disc of magnetic material resiliently biased into electrical contact between respective contact pairs.

3. The invention as claimed in claim 2 further defined by the round having at least three pair of electrical contacts.

4. The invention as claimed in claim 2 or 3 wherein each shorting disc is normally spring biased in a radially inward direction relative to a longitudinal extent of the round.

5. The invention as claimed in claim 4 further defined by the means on the launch tube for disestablishing the round shorting means comprising magnet means facing the launch tube opening for withdrawing the shorting discs from biased contact with the round contacts when the round is loaded therein.

6. In combination:

a prepackaged round and a launcher therefor;

said pre-packaged round including a missile round with an electrically ignited rocket motor environmentally sealed within an electromagnetic radiation shielded cylindrical housing from which the missile round is adapted to exit upon rocket motor ignition;

plural electrical contact annularly disposed in pairs outside the cylindrical housing connected in parallel with rocket motor ignition circuitry, whereby any pair thereof is adapted to receive current from an outside source for igniting the rocket motor;

means normally establishing shorting between the prepackaged round contact pairs thereby minimizing opportunity for electromagnetic radiation emanating from a source outside the housing to invade the round ignition circuitry through the electrical contacts and prematurely ignite the motor;

said launcher including a launch tube for receiving the prepackaged round;

means on the launch tube for disestablishing the shorting means on the prepackaged round when it is loaded into the launch tube;

said launcher including an electrical power source and contacts internally of the launch tube for engaging the prepackaged round electrical contacts when the prepackaged round is loaded into the launch tube;

whereby current selectively supplied to the prepackaged round contacts passes therethrough to the ignition circuitry for igniting the rocket motor.

7. The invention according to claim 6 wherein the electrical contacts on the launch tube surround substantially the entire opening thereof whereby electrical contact with contacts of the prepackaged round is assured regardless of angular indexing of the prepackaged round within the launch tube opening.

8. The invention according to claim 6 wherein the shorting means comprises electrically conductive discs of magnetic material spring biased in radially inward directions relative to the prepackaged round's longitudinal axis for contact with respective contact pairs.

9. The invention according to claim 6 or 8 wherein the means on the launch tube for disestablishing the shorting means on the prepackaged round comprises magnetic means.

10. The invention according to claim 9 wherein the magnetic means comprises a magnet disposed annularly about the inner periphery of the launch tube in surrounding proximity to the prepackaged round shorting discs to attract them radially away from their respective contacts when the prepackaged round is loaded in the launch tube for launching.

11. The invention according to claim 8 wherein at least three pairs of contacts are generally equispaced about the outside of the prepackaged round housing.

12. The invention according to claim 11 wherein the shorting discs have mass whereby force components acting thereon which would tend to dislodge discs on one side of the round away from shorting position against respective contacts also tends to seat discs on the opposite side of the round against respective contact with greater force.

13. A prepackaged round including a rocket motor propelled round environmentally sealed within an electromagnetic radiation shielded cylindrical housing;

said prepackaged round adapted to be loaded into a launch tube for launching;

pairs of electrical contacts annularly disposed about the outer periphery of the cylinder housing;

each of said electrical contact pairs connected in electrical parallel with rocket motor ignition circuitry and adapted to direct current thereinto from an outside source for selective activation of the rocket motor;

electrically conductive discs formed of magnetic material normally radially biased into said contact pairs for establishing electrical short therebetween, thereby minimizing opportunity for electromagnetic radiation from an outside source to enter the rocket motor ignition circuitry through the electrical contacts and prematurely activate the rocket motor;

whereby when the prepackaged round is loaded into a launch tube which has a magnet surrounding its opening, its magnetic shorting discs are attracted toward the magnet to disestablish shorting between respective contact pairs which allows ignition current to enter through the contacts to the ignition circuitry to ignite the rocket motor.

14. The invention according to claim 13 wherein at least three pairs of electrical contacts are disposed about the outer periphery of the cylindrical housing.

15. The invention according to claim 14 wherein the biased shorting discs have mass whereby force components action on the prepackaged round tending to dislodge discs on one side thereof away from shorting contact also tends to seat discs on the opposite side thereof with even more force.

* * * * *